US009413062B2

(12) United States Patent
Ortiz

(10) Patent No.: US 9,413,062 B2
(45) Date of Patent: Aug. 9, 2016

(54) MOUNTING FLANGE FOR INSTALLATION OF DISTRIBUTED ANTENNA SYSTEMS

(71) Applicant: Ethertronics, Inc., San Diego, CA (US)

(72) Inventor: Francisco Carlos Sanchez Ortiz, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 14/564,017

(22) Filed: Dec. 8, 2014

(65) Prior Publication Data

US 2015/0207202 A1 Jul. 23, 2015

Related U.S. Application Data

(60) Provisional application No. 61/913,251, filed on Dec. 7, 2013.

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1214* (2013.01)

(58) Field of Classification Search
USPC ..... 248/220.21, 342, 343, 314; 411/160, 411/163, 164; 343/713, 715, 872
See application file for complete search history.

(56) References Cited

U.S. PATENT DOCUMENTS 4,867,698 A * 9/1989 Griffiths ..... 439/317
5,831,579 A * 11/1998 Rudisill ..... 343/702
5,897,090 A * 4/1999 Smith et al. ..... 248/311.2
6,469,678 B1 * 10/2002 Pullen ..... 343/888
6,486,841 B1 * 11/2002 Imahigashi ..... 343/715
6,509,878 B1 * 1/2003 Tornatta et al. ..... 343/715
6,554,555 B2 * 4/2003 Imahigashi ..... 411/533
7,019,701 B2 * 3/2006 Ohno et al. ..... 343/715
7,212,168 B2 * 5/2007 Kozlovski ..... 343/713
7,222,829 B2 * 5/2007 Takahashi ..... 248/231.9
7,268,734 B2 * 9/2007 Cislo ..... 343/713
7,387,518 B2 * 6/2008 Kozlovski ..... 439/92
7,528,784 B2 * 5/2009 Yamada et al. ..... 343/713
7,679,572 B2 * 3/2010 Gray et al. ..... 343/713
7,710,333 B2 * 5/2010 Byrne et al. ..... 343/713
7,855,688 B2 * 12/2010 Schipper et al. ..... 343/713
8,059,044 B2 * 11/2011 Rode et al. ..... 343/713
8,094,085 B2 * 1/2012 Sato et al. ..... 343/872
8,203,496 B2 * 6/2012 Miller et al. ..... 343/715
8,259,018 B2 * 9/2012 Lai et al. ..... 343/711
8,310,403 B2 * 11/2012 Nahar ..... 343/719
2003/0197649 A1 * 10/2003 Kozlovski ..... 343/711
2004/0169118 A1 * 9/2004 Talaucher et al. ..... 248/314
2005/0274863 A1 * 12/2005 Blateri ..... 248/343
2006/0054763 A1 * 3/2006 Fryberger et al. ..... 248/314
2008/0050070 A1 * 2/2008 Gurreri et al. ..... 385/55
2012/0092504 A1 * 4/2012 Murphy ..... G03B 17/02 348/159
2012/0169551 A1 * 7/2012 Christ et al. ..... 343/713

* cited by examiner

*Primary Examiner* — Terrell McKinnon
*Assistant Examiner* — Michael McDuffie
(74) *Attorney, Agent, or Firm* — Coastal Patent Law Group, P.C.

(57) ABSTRACT

The disclosure details a mounting flange for installation of a distributed antenna system (DAS) antenna module, the mounting flange including a base, an inner cylindrical wall, an outer grooved wall, and a plurality of through-holes extending through the base, the outer grooved wall or a combination thereof. The mounting flange may form part of a DAS antenna module kit as being a necessary component for installation of the DAS antenna module.

13 Claims, 3 Drawing Sheets

MOUNTING FLANGE FOR INSTALLATION OF DISTRIBUTED ANTENNA SYSTEMS

CROSS-REFERENCE TO RELATED APPLICATIONS

This application claims benefit of priority with U.S. Provisional Ser. No. 61/913,251, filed Dec. 7, 2013, titled "Nut Washer Combination With Attach Function"; the contents of which are hereby incorporated by reference.

BACKGROUND

1. Field of the Invention

The claimed invention relates to distributed antenna systems installed within large buildings and configured to improve coverage for devices on a communication network; and more particularly, so a mounting flange for improved installation of such distributed antenna systems.

2. Description of the Related Art

For Distributed Antenna Systems (DAS) currently being installed in buildings, required installation time and ease of installation are two primary considerations for selection of such systems. A typical DAS antenna installed in an office building will be attached to a ceiling tile of the type commonly found in modern buildings. The DAS antenna is attached to the surface of the tile that faces downward towards the floor, with a hole cut through the tile to accommodate the coaxial connection required for operation of the antenna. Screws can be used to attach the antenna to the ceiling for support; or to ease installation, a single threaded plastic collar and nut can be used to attach the antenna using a single connection.

SUMMARY

A mounting flange is disclosed for use with installation of DAS antenna modules. The mounting flange includes a monolithic nut and washer combination having a tapered planar base forming a disc-shape, an aperture disposed in a center of the planar base, an inner cylindrical wall extending upwardly at the aperture, and an outer grooved wall extending upwardly from the base at a radial distance from the inner cylindrical wall. The inner cylindrical wall comprises threads disposed about an interior surface for mating with a threaded shaft of a DAS antenna module. The outer grooved wall is connected to the inner cylindrical wall via a plurality of ribs extending therebetween. A plurality of through-holes is provided, each of the through-holes are disposed through a vertical surface of the outer grooved flange and extend downwardly though a horizontal surface of the planar base. Additional through holes may be disposed through a vertical surface of the ribs and extend downwardly though a horizontal surface of the planar base. In this regard, a single-piece mounting flange is provided, the outer grooved wall provides enhanced gripping via the grooved channels, the inner cylindrical wall is configured to mate with a portion of a DAS antenna module, the planar base is tapered to provide a self-loading spring function when installed, and the various through-holes provide a means for attaching safety wire used to secure the installed DAS antenna module to roof-support beams. Other features and benefits are described in the detailed description.

DETAILED DESCRIPTION

In the following description, for purposes of explanation and not limitation, details and descriptions are set forth in order to provide a thorough understanding of the embodiments of the invention. However, it will be apparent to those skilled in the art that the present invention may be practiced in other embodiments, including certain variations or alternative combinations that depart from these details and descriptions. The illustrated embodiment is not intended to be limiting of the spirit and scope of the invention as set forth in the claims.

In a general embodiment, a mounting flange for installation of a distributed antenna system (DAS) antenna module is described. The mounting flange includes at least a base, an inner cylindrical wall, an outer grooved wall, and a plurality of through-holes extending through the base, the outer grooved wall or a combination thereof. The mounting flange may form part of a DAS antenna module kit as being a necessary component for installation of the DAS antenna module.

Now turning to the drawings, FIGS. 1-5 illustrate various views of a mounting flange for installation of a distributed antenna system (DAS) antenna module in accordance with an illustrated embodiment.

Figure 1:
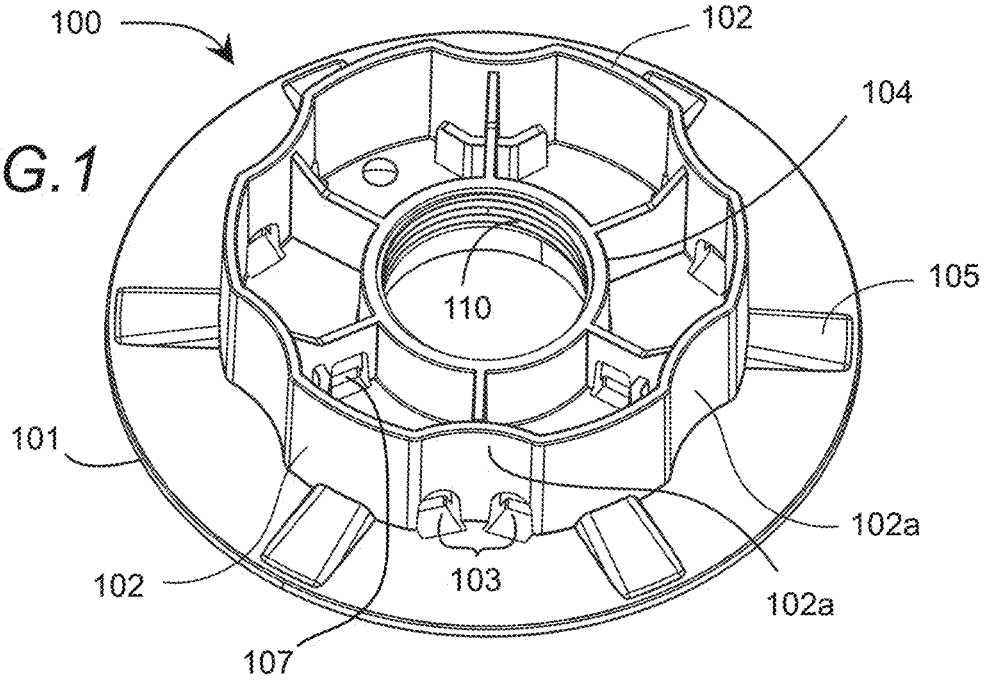
FIG. 1 shows a top perspective of the mounting flange in accordance with an illustrated embodiment.

FIG. 1 shows a top perspective of the mounting flange in accordance with the illustrated embodiment. The mounting flange 100 comprises a base 101 extending outwardly from an aperture 115 to an outer periphery. Though a planar base is shown, an alternative embodiment may comprise a tapered base having a first thickness at a point adjacent to the aperture and a second thickness at a point adjacent to the periphery, wherein said first thickness is greater than said second thickness. In the illustrated embodiment, the planar base further comprises a plurality of tapered braces 105. The tapered base, or tapered braces, respectively, can be chosen for providing self-loading spring capability to the mounting flange. The self-loading spring capability prevents loosening and detachment of the mounting flange from the DAS antenna module for which it is installed. About the base 101 is disposed an inner cylindrical wall 104 extending upwardly therefrom at the aperture 115. The inner cylindrical wall comprises threads 110 disposed about an inner surface thereof, wherein the threads are configured to engage a threaded shaft of the DAS antenna module. An outer grooved wall 102 is disposed between the inner cylindrical wall and the periphery, the outer grooved wall extending upwardly from the base and comprising a plurality of groove channels 102*a* disposed about a circumference thereof. The outer grooved wall 102 is shown being disposed about half the distance between the inner cylindrical wall and the periphery of the base; however, the outer groove wall can be varied in terms of positioning relative to the base. The mounting flange further comprises a plurality of first through-holes 103 extending through a vertical surface of the outer grooved wall, through the base, or a combination thereof. The first through-holes 103 are configured to receive safety wire therethrough for securing the mounting flange to a roof structure.

Figure 2:
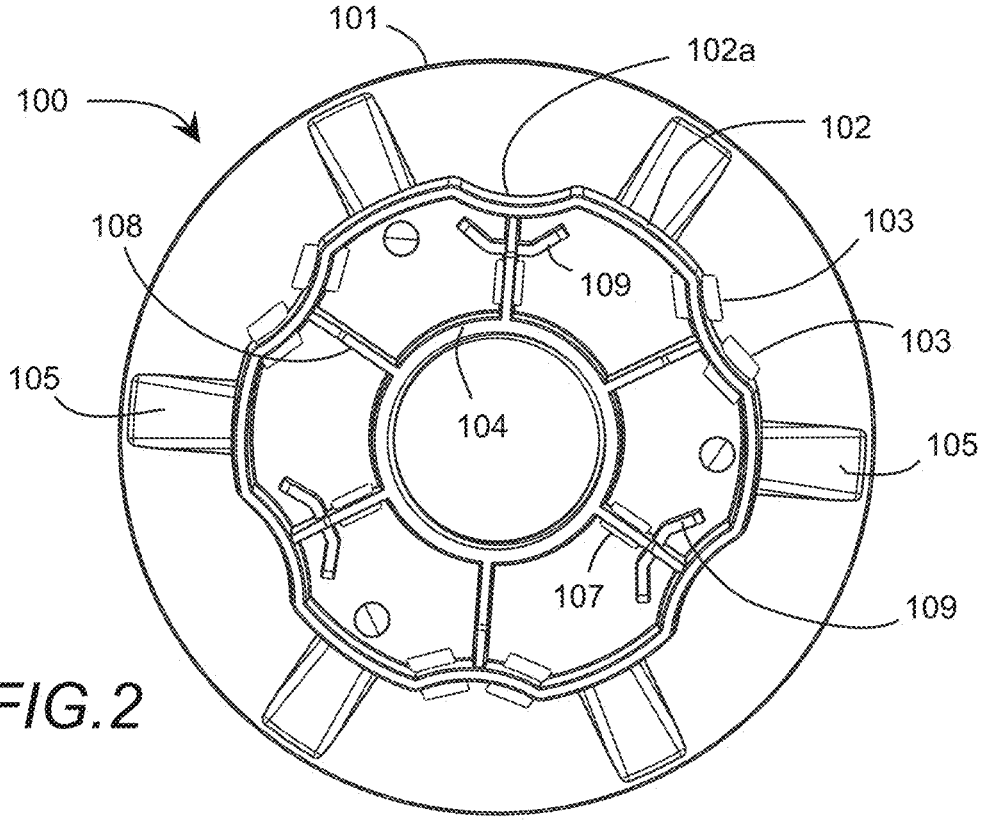
FIG. 2 shows a top view of the mounting flange in the illustrated embodiment.

FIG. 2 shows a top view of the mounting flange in the illustrated embodiment. A plurality of ribs 108 are shown, the ribs extending from the outer grooved wall to the inner cylindrical wall and configured for support thereof. The ribs 108 can optionally comprise one or more second through-holes 107. The second through-holes are configured to extend through a vertical surface of the ribs, and they may optionally further extend through the base. The second through-holes are also used for attaching safety wire to secure the flange to a roof structure.

As shown, the ribs may comprise a tapered rib having a first height adjacent to the grooved channel of the grooved wall and a second height adjacent to the inner cylindrical wall, wherein the first height is greater than the second height. The tapered rib helps to provide leveraged stability to the mounting flange components.

The mounting flange can further comprise one or more rib supports 109 as shown in FIG. 2. The rib supports connect and brace the ribs with the base.

Figure 3:
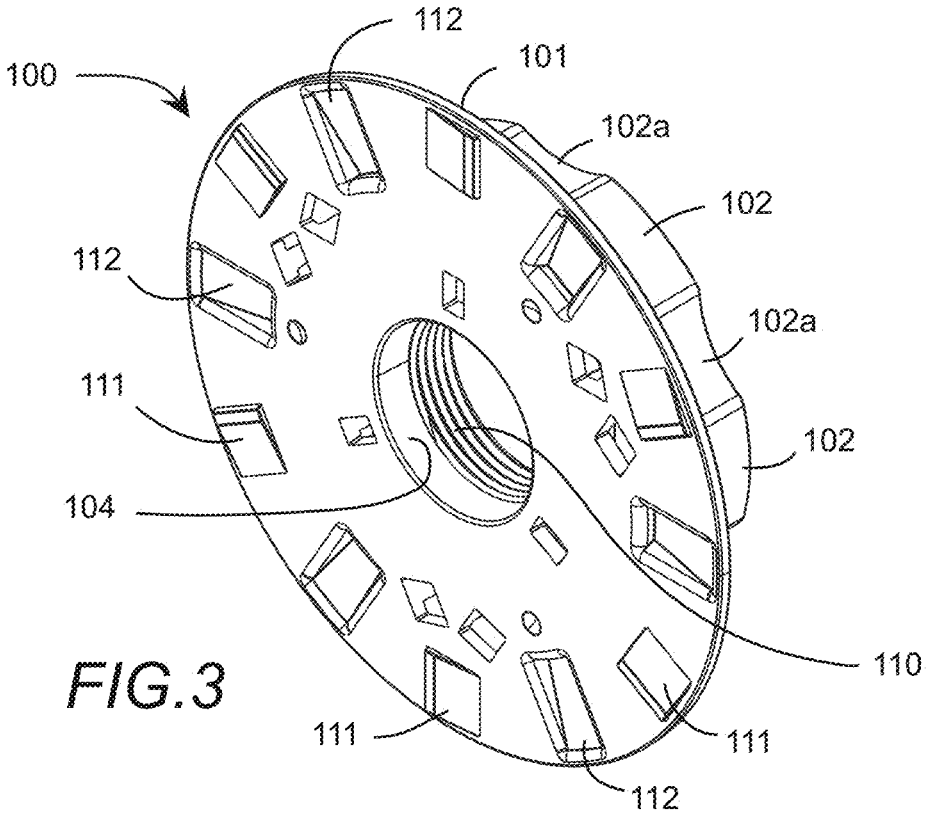
FIG. 3 shows a bottom perspective of the mounting flange in the illustrated embodiment.

FIG. 3 shows a bottom perspective of the mounting flange in the illustrated embodiment. Each tapered brace is shown having a tapered brace void 112 disposed directly beneath it as seen on the bottom side of the base. In this regard, the hollowed tapered braces provide a spring mechanism for self-loading the bias force provided by the base. The threads 110 are shown disposed about the inner surface of the cylindrical wall 104. The mounding flange is shown further comprising optional locking teeth 111. The locking teeth are disposed adjacent to a periphery of the base about the bottom side thereof. The locking teeth are shown having a tapered slope for enabling rotational engagement while prohibiting disengagement. Variations of the locking teeth can comprise hooks, points, bumps, or other frictional tooth designs.

Figure 4:
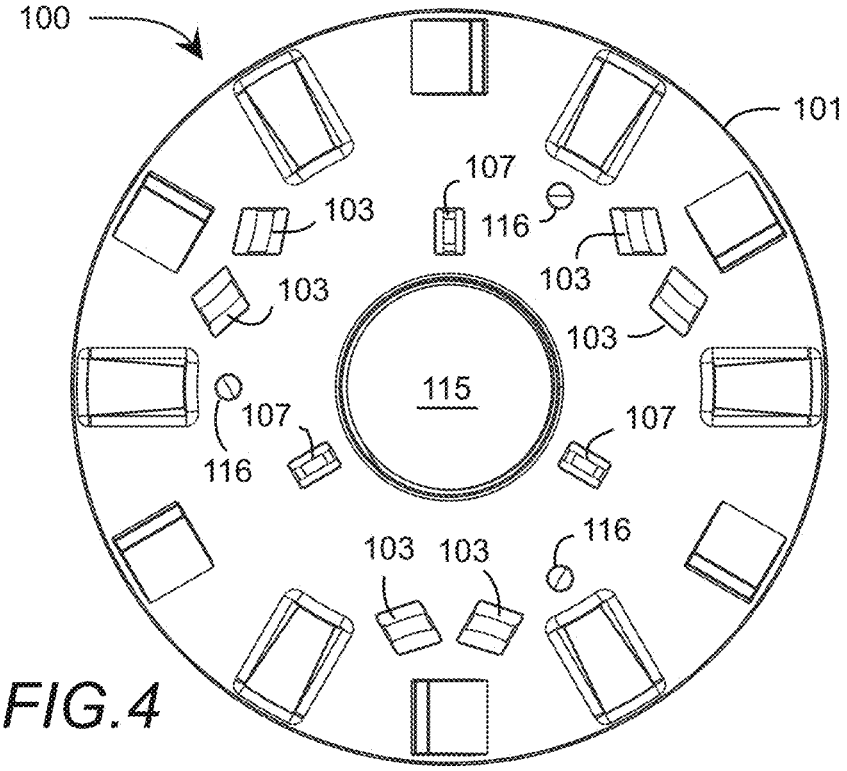
FIG. 4 shows a bottom view of the mounting flange in the illustrated embodiment.

FIG. 4 shows a bottom view of the mounting flange in the illustrated embodiment. The aperture 115 of the mounting flange is shown. In addition, the first through-holes 103 and second through-holes 107 are each shown extending through the base 101. A plurality of dome-voids 116 may be provided for locating screws that can be inserted through the dome voids to attach and fixedly retain the position of the mounting flange subsequent to installation with a DAS antenna module.

Figure 5:
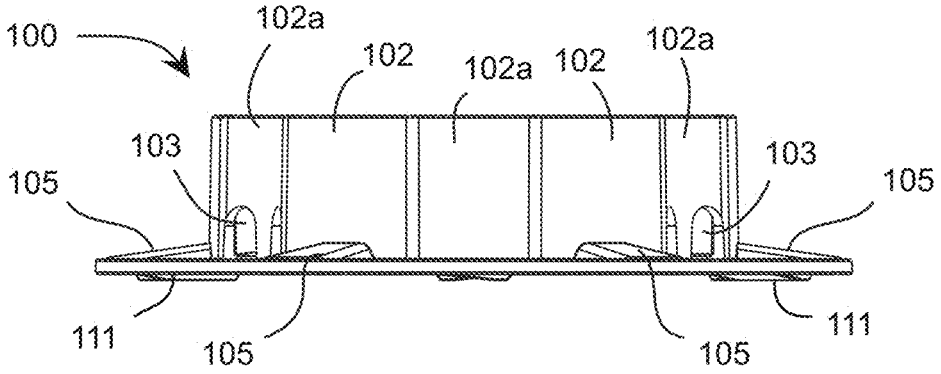
FIG. 5 shows a side view of the mounting flange in the illustrated embodiment.

FIG. 5 shows a side view of the mounting flange in the illustrated embodiment. Each of the base 101, outer grooved wall 102, groove channels 102*b*, tapered braces 105, and first through-holes 103 can be further seen from the side view of the mounting flange 100 as shown in FIG. 5.

Figure 6:
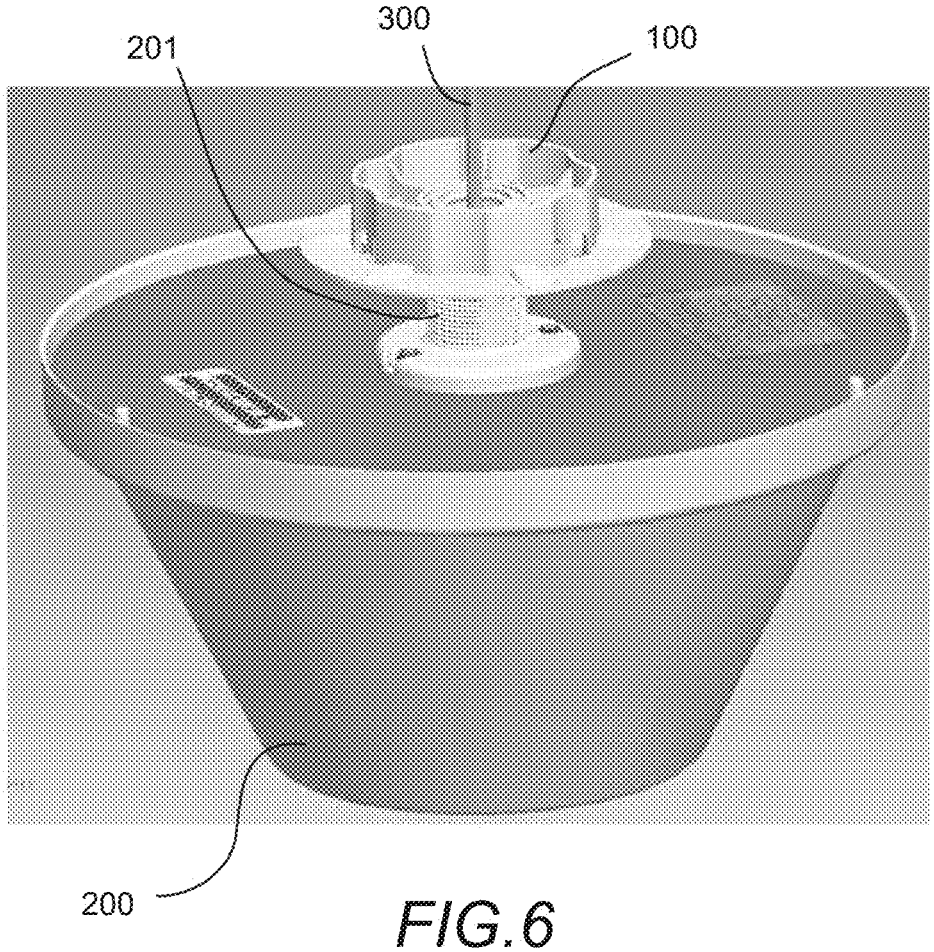
FIG. 6 shows the mounting flange coupled to a DAS antenna module in a post-installation configuration.

FIG. 6 shows the mounting flange coupled to a DAS antenna module in a post-installation configuration. The mounting flange 100 is engaged with the threaded shaft 201 of the DAS antenna module 200. A coaxial cable 300 used to connect the DAS antenna module to the system transceiver is shown extending through the aperture of the mounting flange.

The mounting flange as shown can be fabricated as a molded piece, or a billet component. Though the mounting flange may comprise aluminum or other metals, plastics and composite materials are preferred for at least the reason that such can be manufactured at a lower cost with respect to metals. Injection molding of plastic materials may be a preferred method for fabricating the mounting flange.

REFERENCE CHARACTERS LIST

Mounting Flange 100
Planar Base 101
Outer Wall 102
Grooved Channel 102*a*
First Through-Holes 103
Inner Cylindrical Wall 104
Tapered Brace 105
Second Through-Holes 107
Ribs 108
Rib Support 109
Threads 110
Locking Teeth 111
Tapered Brace Void 112
Aperture 115
Dome Voids 116
DAS Antenna Module 200
Threaded Shaft 201
Coaxial Cable 300

What is claimed is:

1. A mounting flange for installation of a distributed antenna system (DAS) antenna module, the mounting flange comprising:

a base extending within a horizontal plane from a center to an outer periphery, an aperture being disposed at the center of the base;

an inner cylindrical wall extending upwardly from the base at the aperture, the inner cylindrical wall comprising threads disposed about an inner surface thereof;

an outer grooved wall extending upwardly from the base, the outer grooved wall being disposed between the inner cylindrical wall and the periphery of the base, the outer grooved wall characterized with a plurality of grooved channels extending vertically from the base, the plurality of grooved channels forming a corrugated surface of the outer grooved wall, wherein said outer grooved wall is connected to the inner cylindrical wall via a plurality of ribs extending therebetween; and a plurality of first through-holes disposed about one or more of the outer grooved wall and the base.

2. The mounting flange of claim 1, one or more of said first through-holes extending through a vertical surface of one of said grooved channels.

3. The mounting flange of claim 2, said one or more first through-holes extending through the vertical surface of one of the grooved channels further extending through the base.

4. The mounting flange of claim 1, wherein said base comprises a tapered brace having a first thickness at a point adjacent to the aperture and a second thickness at a point adjacent to the periphery, wherein said first thickness is greater than said second thickness.

5. The mounting flange of claim 1, wherein said base comprises a planar base having one or more tapered braces extending upwardly from a top surface of the planar base, the tapered braces being coupled to the outer grooved wall and extending radially outward toward the periphery, each of the tapered braces having a first thickness at a point adjacent to the outer grooved wall and a second thickness at a point adjacent to the periphery, wherein said first thickness is greater than said second thickness.

6. The mounting flange of claim 5, wherein each of the tapered braces further comprises a tapered brace void disposed beneath the tapered brace about a bottom surface of the planar base.

7. The mounting flange of claim 1, further comprising one or more locking teeth disposed adjacent to the periphery of the base about a bottom surface thereof.

8. The mounting flange of claim 1, further comprising at least one rib brace, the at least one rib brace coupled to one of said ribs and the base for providing structural support.

9. The mounting flange of claim 1, wherein said ribs comprise a tapered rib having a first height adjacent to the grooved channel of the grooved wall and a second height adjacent to the inner cylindrical wall, wherein the first height is greater than the second height.

10. The mounting flange of claim 1 comprising at least one second through-hole being configured to extend through a vertical wall of one of said ribs.

11. The mounting flange of claim 10, said at least one second through-hole further extending through the base.

12. A distributed antenna system (DAS) antenna module and mounting flange kit, comprising:

a digital antenna system antenna module having a threaded shaft extending upwardly from a top surface thereof; and a mounting flange configured to mate with the threaded portion of the threaded shaft, the mounting flange comprising:

a base extending in a horizontal plane from an aperture disposed at a center thereof to an outer periphery;

an inner cylindrical wall extending upwardly from the base at the aperture, the inner cylindrical wall comprising threads disposed about an inner surface thereof;

an outer grooved wall extending upwardly from the base, the outer grooved wall being disposed between the inner cylindrical wall and the periphery of the base, the outer groove wall characterized with a plurality of grooved channels extending vertically from the base, the plurality of grooved channels forming a corrugated wall surface, wherein said outer grooved wall is connected to the inner cylindrical wall via a plurality of ribs extending therebetween; and a plurality of first through-holes disposed about one or more of the outer grooved wall and the base.

13. A mounting flange for installation of a distributed antenna system (DAS) antenna module, the mounting flange comprising:

a base extending within a horizontal plane from a center to an outer periphery, an aperture being disposed at the center of the base;

an inner cylindrical wall extending upwardly from the base at the aperture, the inner cylindrical wall comprising threads disposed about an inner surface thereof;

an outer grooved wall extending upwardly from the base, the outer grooved wall being disposed between the inner cylindrical wall and the periphery of the base, the outer grooved wall characterized with a plurality of grooved channels extending vertically from the base, the plurality of grooved channels forming a corrugated surface of the outer grooved wall, wherein said outer grooved wall is connected to the inner cylindrical wall via a plurality of ribs extending therebetween; and a plurality of through-holes, the plurality of through-holes being configured to receive and engage safety wire for securing the mounting flange to a roof structure.

* * * * *